US006637235B2

(12) United States Patent
Sakamoto et al.

(10) Patent No.: US 6,637,235 B2
(45) Date of Patent: Oct. 28, 2003

(54) FRIDGE-FREEZER

(75) Inventors: Katsumasa Sakamoto, Tokyo (JP); Toshie Hiraoka, Tokyo (JP); Keiji Ohya, Tokyo (JP); Naho Misumi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/112,772

(22) Filed: Apr. 2, 2002

(65) Prior Publication Data

US 2003/0010056 A1 Jan. 16, 2003

(30) Foreign Application Priority Data

Jul. 13, 2001 (JP) ..... 2001-213918

(51) Int. Cl.[7] ..... F25D 11/02; F25D 23/06

(52) U.S. Cl. ..... 62/443; 62/441; 62/446; 62/451

(58) Field of Search ..... 62/441, 443, 451, 62/407, 418, 446

(56) References Cited

U.S. PATENT DOCUMENTS 2,775,873 A * 1/1957 Jones ..... 62/281

5,048,306 A * 9/1991 Wakatsuki et al. ..... 62/419

FOREIGN PATENT DOCUMENTS

| | | |
|---|---|---|
| JP | 61-191860 | 8/1986 |
| JP | 2000-320943 | 11/2000 |

* cited by examiner

*Primary Examiner*—Chen Wen Jiang
(74) *Attorney, Agent, or Firm*—Oblon, Spivak, McClelland, Maier & Neustadt, P.C.

(57) ABSTRACT

A refrigerator which may allow vegetables kept more fresh by minimizing temperature fluctuations in a vegetable compartment. The refrigerator minimizes dehydration in food stored in the vegetable compartment, so that vegetables are kept fresh longer. The vegetable compartment is arranged so as to be surrounded by freezing temperatures, and cooled through radiation cooling without receiving blowing cool air thereto to minimize temperature fluctuations, so that vegetables may be keep more fresh. At the same time, the vegetable compartment is sealed so that convection does not occur thereby minimizing dehydration in food, so that food is allowed to be kept fresh longer. Furthermore, the refrigerator is provided with compartments whose temperatures may be set to freezing temperatures. The vegetable compartment is arranged so as to be surrounded by compartments whose temperatures are freezing temperatures via partition parts.

19 Claims, 11 Drawing Sheets

FRIDGE-FREEZER

BACKGROUND OF THE INVENTION

1. Field of the Invention

The present invention relates to a fridge-freezer which is provided with a storage such as a vegetable compartment for storing fresh food together with a refrigerator room and a freezer. More particularly, the present invention relates to a fridge-freezer in which vegetables as fresh food are cooled in the vegetable compartment where temperature fluctuations are minimized through radiation cooling without supplying direct cool air to the vegetable compartment.

2. Description of the Related Art

A conventional refrigerator refrigerates a vegetable compartment by supplying cool air directly blowing into the vegetable compartment. This results in causing big temperature fluctuations in the vegetable compartment. In addition to that, convection may occur in the vegetable compartment, which develops dehydration in food stored in the vegetable compartment. This has made food stay fresh shorter. For example, FIG. 16 shows a refrigerator with the layout that a refrigerator room 100 is arranged at the top, a convertible compartment 400 and an ice-maker 500 are arranged below the refrigerator room 100, a freezer 200 is arranged at the bottom, and a vegetable compartment 300 is arranged above the freezer 200. The vegetable compartment 300 is provided with a drawer-type door and contains a vegetable case 301 and a fruit case 302. Those cases are designed to have an open top so as to have easy access to things stored. FIG. 17 is a structural diagram of a vegetable compartment. The vegetable compartment is structured such that cool air 4 for cooling the vegetable compartment blows off from the top surface into the vegetable compartment, and then returns to a cooling device chamber 3 through a return passage 9 for the vegetable compartment.

According to such a structure as introduced above, the vegetable case and the fruit case are designed not to receive direct cool air blowing inside for the purpose of preventing vegetables from being dried or frozen. No matter if the cases are provided with lids or not, however, convection of cool air occurs in the vegetable compartment, which develops dehydration in vegetables. At the same time, big temperature fluctuations occur in the vegetable compartment. On the other hand, as an art for preventing deterioration in food through indirectly cooling a vegetable compartment, Japanese Unexamined Patent Publication No. SHO61-191860 and Japanese Unexamined Patent Publication No. HEI4-76372 are known. However, the former uses the temperature of return cool air from the refrigerator room for an indirect cooling, therefore, fails to obtain a cooling effect sufficiently because of a temperature rise by opening/closing the door. For that reason, a special structure and an extra space such as a hollow cooling device chamber are needed, which has made the refrigerator complicated and costly. The latter, in order to keep the inside temperature of the refrigerator as low as 1° C., is provided with evaporators around the outer casing for minimizing an intense respiration effect. Then, a fan is provided inside the inner casing which is formed via an air layer so as to try to achieve a constant temperature inside the inner casing. As a result, a large-scale device is required, which has posed a problem. In addition to that, this has to move cool air, so that dehydration may be aggravated, which has posed another problem.

SUMMARY OF THE INVENTION

It is an object of the present invention to obtain a fridge-freezer such as a home refrigerator, which is simply structured and allows to make fresh food such as vegetables stay fresh longer in storage. Another object of the present invention is to make vegetables fresh longer in a food storage for storing food such as vegetables by minimizing temperature fluctuations in the storage through radiation cooling without blowing cool air into the storage. Still another object of the present invention is to obtain a fridge-freezer which is convenient in use.

These and other objects of the embodiments of the present invention are accomplished by the present invention as hereinafter described in further detail.

According to one aspect of the present invention, a fridge-freezer may include a food storage which is placed vertically between compartments such as a refrigerator room and a freezer via partition parts, and formed so that food such as vegetables stored therein is allowed to be taken out by opening/closing a door, a cooling device chamber, cooling air ducts for guiding return cool air from such as the refrigerator room to the cooling device chamber through the partition parts for separating the food storage from the compartments, a radiation cooling unit, which is provided between at least a part of the cooling air ducts and the food storage, for performing radiation cooling of the food storage by cold of cool air in the cooling air ducts, and a storage case which is contained in the food storage and allowed to be sealed for storing food such as vegetables. Then, the food storage is cooled without receiving cool air directly.

According to one aspect of the present invention, a fridge-freezer may include a food storage for storing food such as vegetables, a refrigerator room which is placed above the food storage, a freezer which is placed below the food storage, a cooling device chamber which is placed at a back of the food storage, partition parts for separating the food storage at least from the freezer and the cooling device chamber, radiation cooling units which are provided on the partition parts, for cooling the food storage by return cool air from the refrigerator room without supplying return cool air directly to the food storage, and a storage case which is contained in the food storage and allowed to be sealed for storing food such as vegetables. Then, the food storage is cooled by isolating the food from a flow of cool air.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
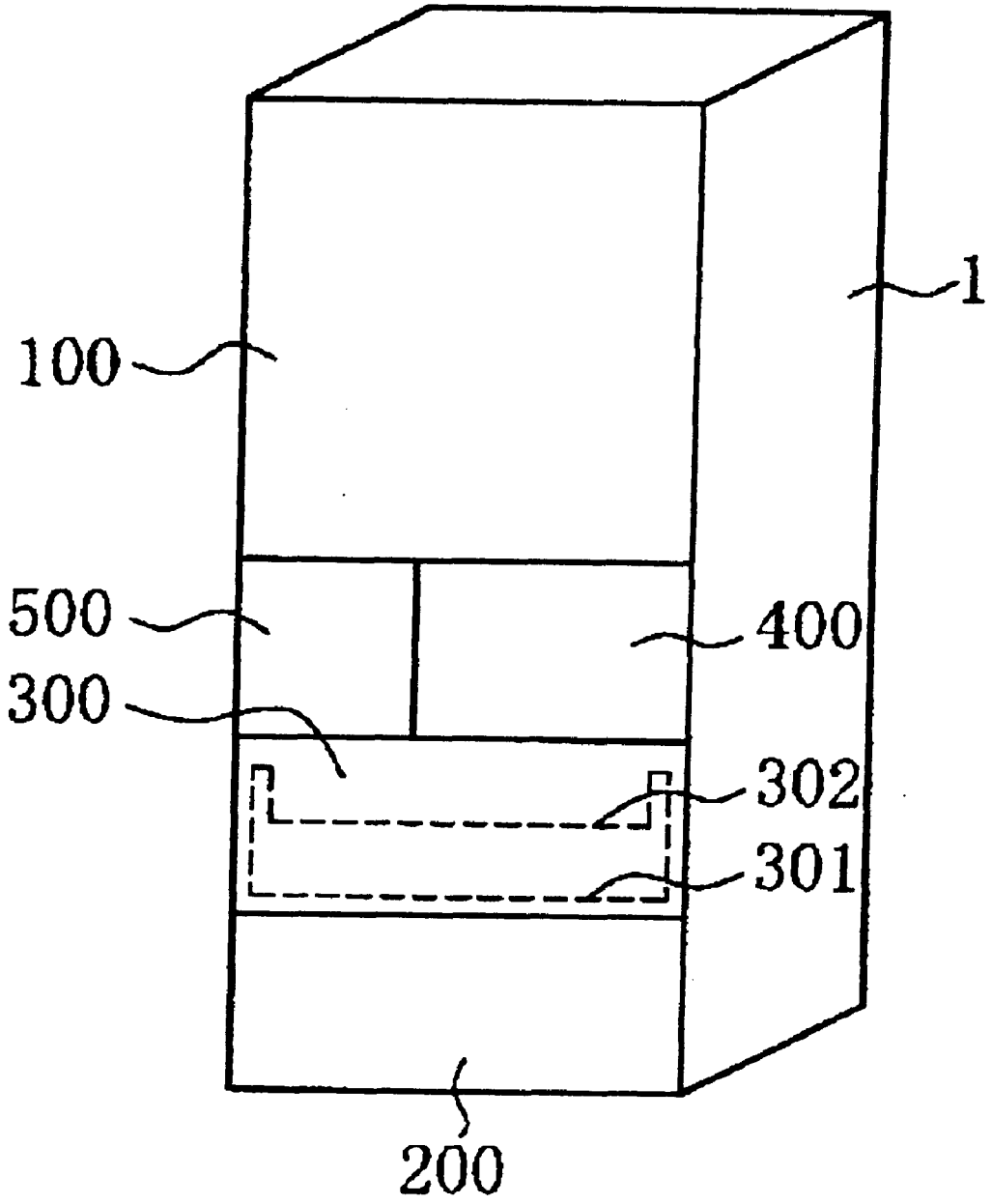
FIG. 1 is a layout drawing of a vegetable compartment of a refrigerator according to a first embodiment of the present invention.

Reference will now be made in detail to the present preferred embodiments of the invention, examples of which are illustrated in the accompanying drawings, wherein like reference numerals indicate like elements through out the several views.

Embodiment 1

Hereinafter, the embodiments of the refrigerator according to the present invention will be discussed with reference to drawings. It is to be noted that the same elements will be represented by the same reference numerals or signs and the explanations will not be repeated. FIG. 1 shows an embodiment of a refrigerator according to the present invention. FIG. 1 is an explanatory drawing of a vegetable compartment of the refrigerator. A reference numeral 1 denotes a body of the refrigerator which includes a refrigerator room 100 which is arranged at the top, a convertible compartment 400 (a multi-purpose compartment) and an ice-maker 500 which are arranged side by side below the refrigerator room 100, a freezer 200 (a freezer compartment) which is arranged at the bottom, and a vegetable compartment 300 which is arranged between the freezer 200, and the convertible compartment and the ice-maker. The refrigerator room 100 has an opening/closing door. The convertible compartment 400 is allowed to switch temperatures from a freezing temperature (−18° C.) to cooling temperatures, temperatures for storing vegetables, and chilling temperatures. Drawer-type doors are provided for the convertible compartment 400, ice-maker 500, freezer 200, and vegetable compartment 300, respectively. The vegetable compartment 300 contains a vegetable case 301 and a fruit case 302 for storing food such as vegetables.

Figure 2:
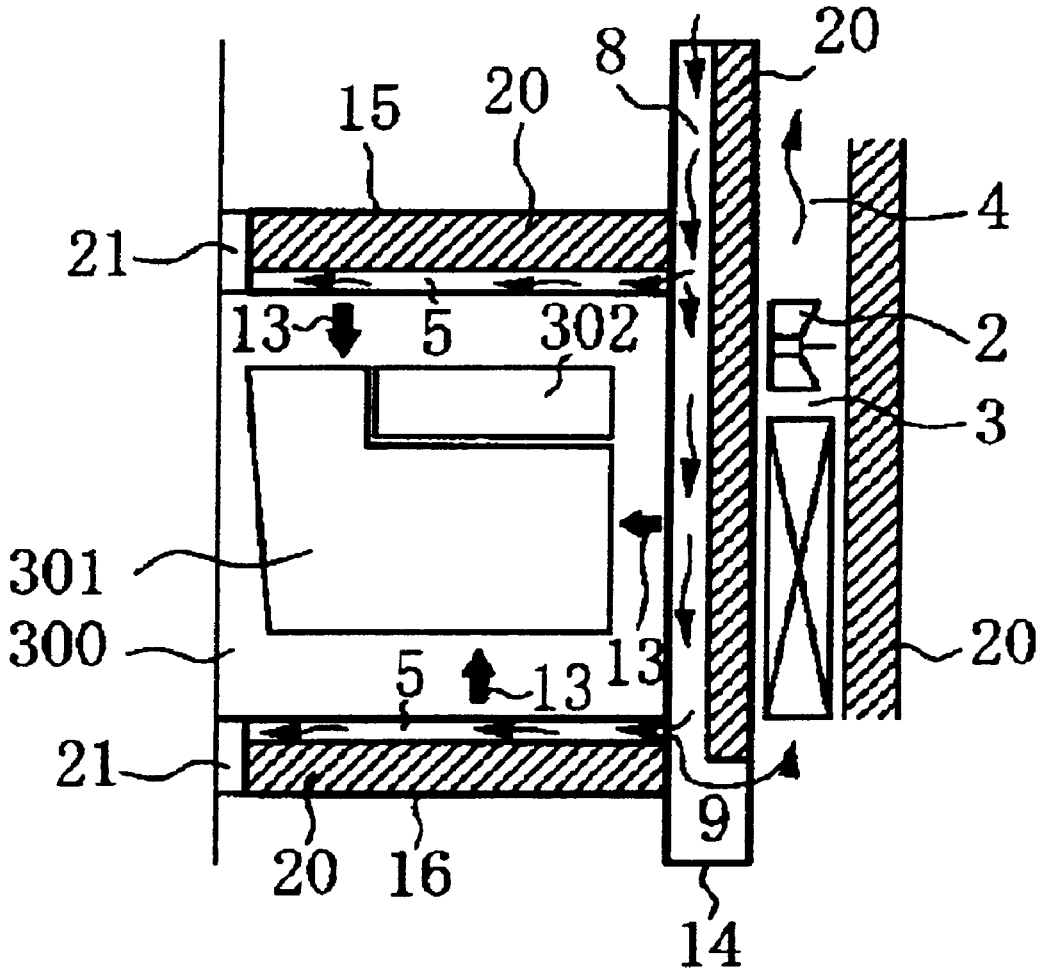
FIG. 2 is a structural drawing of the vegetable compartment of the refrigerator according to the first embodiment of the present invention.
Figure 3:
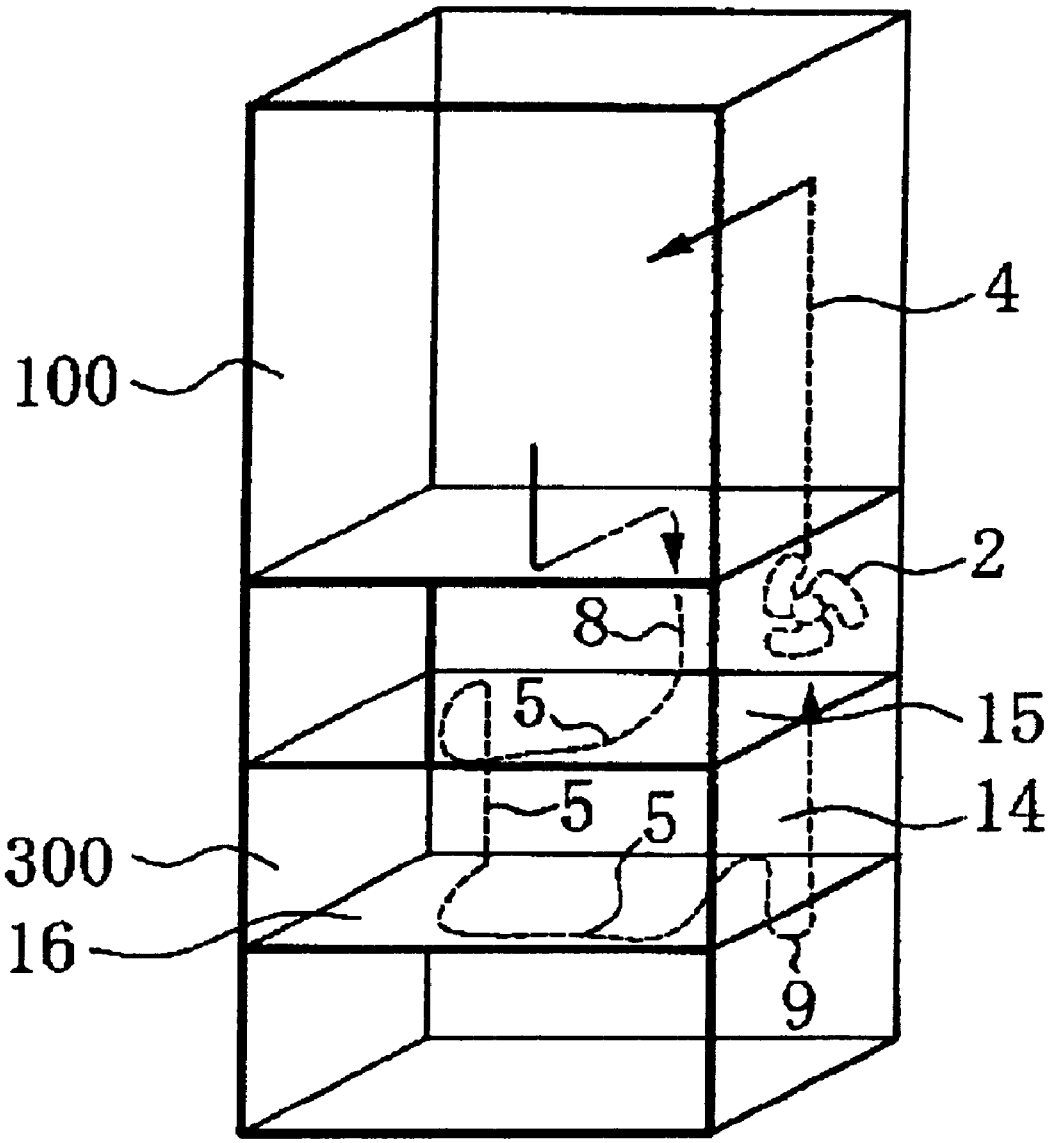
FIG. 3 is a block diagram of cooling air ducts of the refrigerator according to the first embodiment of the present invention.
Figure 4:
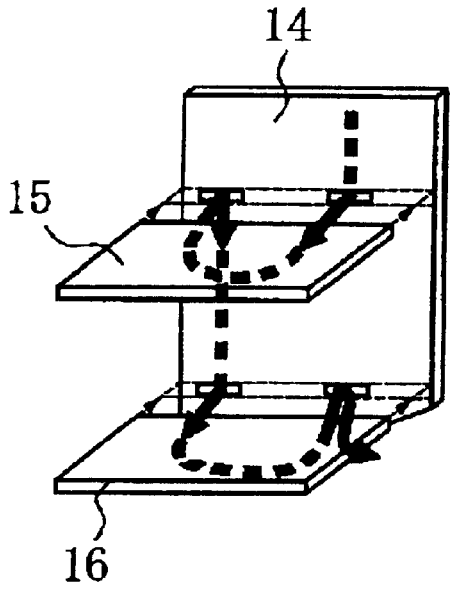
FIG. 4 is a block diagram of cooling air ducts of the refrigerator according to the first embodiment of the present invention.

FIG. 2 is a side sectional view of the structure of a vegetable compartment according to the first embodiment. FIGS. 3, 4 are structural diagrams illustrating cooling air ducts. A reference numeral 2 denotes a fan for circulating cool air 4 from a cooling device chamber 3. A reference numeral 5 denotes a cooling air duct for the vegetable compartment. The air duct 5 is formed in each of a partition part 14 for separating the vegetable compartment from the cooling device chamber for cooling the vegetable compartment 300, a partition part 15 for separating the vegetable compartment from the ice-maker and the convertible compartment, and a partition part 16 for separating the vegetable compartment from the freezer. A reference numeral 8 denotes a return passage for the refrigerator room. A reference numeral 9 denotes a return passage for the vegetable compartment. A reference numeral 13 represents radiation cooling for cooling the vegetable compartment through the respective partition parts. A reference numeral 20 denotes a heat insulating material which is provided inside the respective partition parts for insulating heat. The partition part 14, which is formed by the heat insulating material for providing heat insulation between the cooling device chamber 3 and the vegetable compartment and the cooling air duct 5 for the vegetable compartment, is built in at the back of the vegetable compartment 300 in the refrigerator. Similarly, the partition part 15, which is formed by the heat insulating material for providing heat insulation between the ice-maker 500 and convertible compartment 400 and the vegetable compartment and the cooling air duct for the vegetable compartment, is built in on the top surface of the vegetable compartment. Then, the partition part 16, which is formed by the heat insulating material for providing heat insulation between the freezer 200 and the vegetable compartment and the cooling air duct 5 for the vegetable compartment, is built on the bottom surface of the vegetable compartment. The cool air 4 which is cooled in the cooling device chamber 3 is circulated through the refrigerator room by the fan 2. The vegetable compartment 300 is cooled by receiving return cool air from the refrigerator room 100 circulating through the return passage 8 for the refrigerator room. Then, the return cool air returns to the cooling device chamber 3 through the return passage 9 for the vegetable compartment. It is to be noted in this case that the return cool air is not directly blown into the vegetable compartment. The vegetable compartment is cooled through the radiation cooling 13 with the return cool air supplied to the air ducts 5 for cooling the vegetable compartment which are provided on all or part of the top, back, and bottom surfaces of the vegetable compartment.

The partition part 14, 15, 16 is covered by a plastic shell, in which the cooling air duct for the vegetable compartment is formed on the vegetable compartment 300 side and the heat insulating material 20 is formed on the other side so as to insulate the vegetable compartment from cold in such as the freezers placed above and below the vegetable compartment. In this case, the vegetable compartment is subject to radiation cooling through the plastic shell. Also, the vegetable compartment is insulated from cold in the cooling device chamber in the same manner. Alternatively, however, the return cool air from the refrigerator room may be cooled by transferring cold in a compartment of lower temperature such as the freezer whose temperature is −18° or less than that and the cooling device chamber to the cooling air duct 5 for the vegetable compartment. With referring to FIG. 2 through FIG. 4, the air ducts for cooling the vegetable compartment are provided on all the top, back and bottom surfaces of the vegetable compartment. Alternatively, however, one of the air ducts for cooling the vegetable compartment may be enough if sufficient radiation cooling is achieved with cool air at a lower temperature. This may minimize temperature fluctuations in the vegetable compartment because cool air does not blown directly into the vegetable compartment. As a result, the vegetable compartment is allowed to have constant temperatures. At the same time, this may remove the necessity of protecting vegetables from direct cool air by enclosing vegetables with the sides and the bottom surface, unlike the conventional fruit case 302 and vegetable case 301. This may give more flexibility to designing a case, so that the case is allowed to be latticed or include holes. On top of it, such a latticed case or a case with holes may contribute to allowing the vegetable compartment to receive radiation cooling from various directions.

With reference to FIG. 2, a side sectional view of the structure of the vegetable compartment of the refrigerator according to the present invention, the cool air 4 which is cooled in the cooling device chamber 3 is circulated through the refrigerator room by the fan 2. The vegetable compartment 300 is cooled by receiving return cool air from the refrigerator room 100 circulating through the return passage 8 for the refrigerator room. Then, the return cool air returns to the cooling device chamber 3 through the return passage 9 for the vegetable compartment. It is to be noted in this case that the return cool air is not directly blown into the vegetable compartment. The vegetable compartment is cooled through the radiation cooling 13 with the return cool air supplied to the air ducts 5 for cooling the vegetable compartment which are provided on all or part of the top, back, and bottom surfaces of the vegetable compartment. For that reason, the vegetable compartment is completely closed, and convection in the vegetable compartment is minimized. As a result, dehydration level in vegetables may be improved by about 25–50% compared to a method of blowing cool air into the vegetable compartment. Thus, dehydration in vegetables may be minimized, so that food is allowed to be kept moisturized. So far, a description has been given of the structure of the vegetable compartment for radiation cooling using the return passage from the refrigerator room. However, the description should be applied not only to vegetable compartment but also to the case of fresh food such as fish and meat to be refrigerated at around 0° C. In that case, it should also be allowed that cool air returning from a compartment whose temperatures are −5° to −8°, for example, is used other than the return passage from the refrigerator room. Furthermore, with reference to the structure of the refrigerator in FIG. 1, such as the convertible compartment is formed between the refrigerator room and the vegetable compartment. Alternatively, however, the refrigerator room and the vegetable compartment may be separated directly by means of a partition part involving no heat insulation. It is applicable to provide the cooling air duct 5 for the vegetable compartment on only one of the top, back, and bottom surfaces. However, it is desirable to provide the air ducts 5 for cooling the vegetable compartment on two or more, e.g. two, surfaces or sides, for the purpose of quickly getting a constant temperature and minimizing convection in the food storage.

According to this invention, the food storage for storing fresh food such as vegetables is designed to be provided at a convenient position of the refrigerator in use for the user. The convenient position may allow the user to store/remove weighty vegetables in/from the food storage in a natural posture with reasonable energy. The convenient position may also provide the user with convenience in frequent movements of storing/removing food in/from the food storage. In other words, the convenient position should not be located in the top part or bottom part of the refrigerator. This means that there are compartments such as the freezer provided above and below the food storage. For that reason, the surfaces of partition parts to be used for separating the food storage from adjacent compartments may be effectively used for radiation cooling. Thus, a required and sufficient radiation cooling may be obtained without difficulty, and the structure for cooling the vegetable compartment is allowed to become very simple. In addition to that, the cooling device chamber is provided at the back of the vegetable compartment. This allows the vegetable compartment to receive cool air from all directions, which means that surfaces to be used for radiation cooling may be increased further. It is to be noted that the cooling air duct 5 for the vegetable compartment provided in the partition part may occupy the whole surface or part of the partition part.

Figure 5:
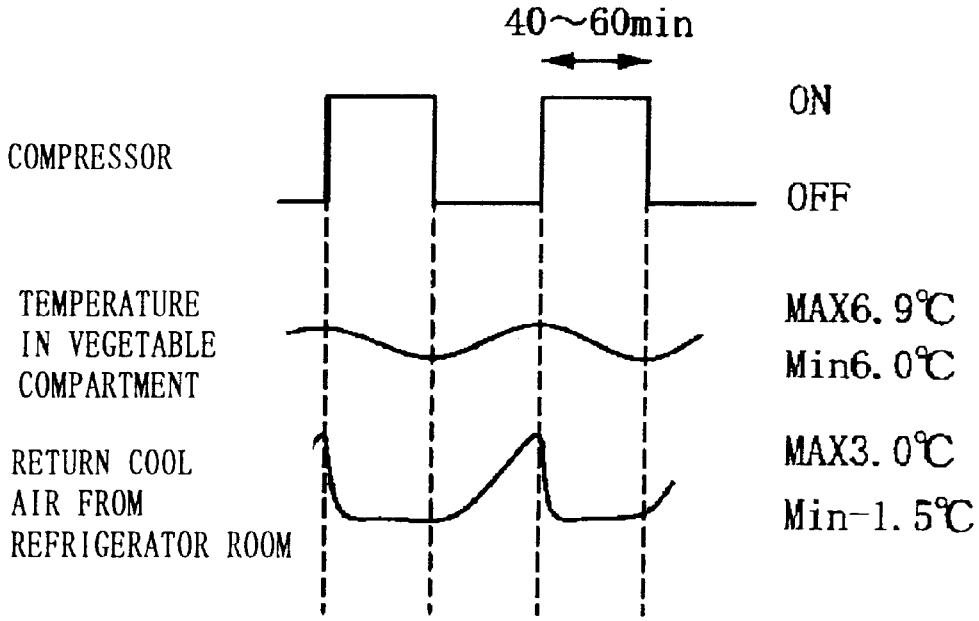
FIG. 5 is an explanatory drawing of a temperature characteristic of the refrigerator according to the first embodiment of the present invention.

Now, a structure for achieving a constant temperature in the vegetable compartment through radiation cooling is discussed. FIG. 5 is an explanatory diagram of a relation between compressor's operation and temperatures. The compressor is operated for 40–60 minutes, during which the cooling device is operated to produce cool air for circulating in the refrigerator, and then stopped. As a result, cool air circulating in the refrigerator is refrigerated through the operation and supplied to the refrigerator room, so that the temperature of the refrigerator room becomes 3° C. with an adjustment by such as a damper. Then, the temperature of return cool air from the refrigerator room is controlled in a range of −1.5° C. to 3° C. as indicated by the diagram when the outside air temperature is about 30° C. In this condition, the temperature of the vegetable compartment is controlled through radiation cooling to become constant in a range of about 6° C. through 6.5° C.

Figure 6:
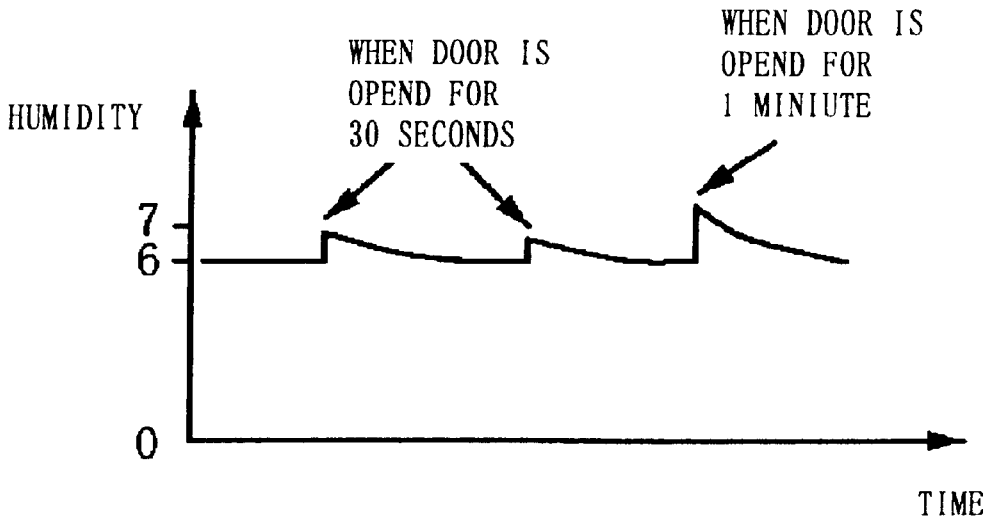
FIG. 6 is an explanatory drawing of a characteristic of door movement of the refrigerator according to the first embodiment of the present invention.

FIG. 6 is an explanatory diagram of temperature change illustrating temperature changes in the vegetable compartment at such a constant temperature when the door is opened/closed. When the door is opened, the fan 2 for circulation cool air in the refrigerator stops, which affects radiation cooling. In addition to that, outside air also enters the vegetable compartment through the open door. The figure illustrates temperature rises in the vegetable compartment when the door is opened for 30 seconds and for 1 minute. The figure also shows that the vegetable compartment is cooled thereafter through radiation cooling to recover an almost constant temperature. Thus, if the temperature rises to 7° C. or more than that when opening the door, the radiation cooling structure shows almost the same recovery speed to recover a given temperature as the conventional structure where cool air is directly supplied to the vegetable compartment.

Figure 7:
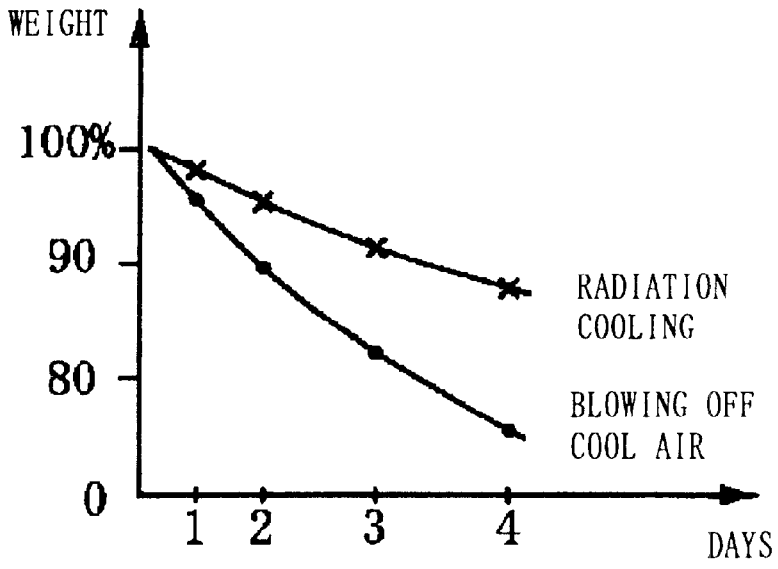
FIG. 7 is an explanatory drawing of holding water in the refrigerator according to the first embodiment of the present invention.

FIG. 7 illustrates a radiation cooling effect on the long-term storage of fresh food. FIG. 7 shows data on weight loss resulted from removal of water in food in the case of storing spinach as an example of the food. In the case of blowing off cool air to circulate in the vegetable compartment, the convection of cool air becomes large in the compartment. As a result, water is removed from vegetables to get dried quickly, so that dehydration is developed in the vegetables considerably. Through radiation cooling, the convection of cool air is small in the compartment, which allows vegetables to lose weight only by about half of that of the conventional structure. Thus, by minimizing the convection of cool air in the vegetable compartment with the structure of the refrigerator of the present invention, fresh food is allowed to stay fresh longer. In addition to that, a storage for storing fresh food is provided at the center of the refrigerator which is considered convenient in use, so that the vegetable compartment is allowed to receive radiation cooling from all directions. This structure may reduce temperature fluctuations, which may improve the property of the refrigerator of making vegetables stay fresh.

Figure 8:
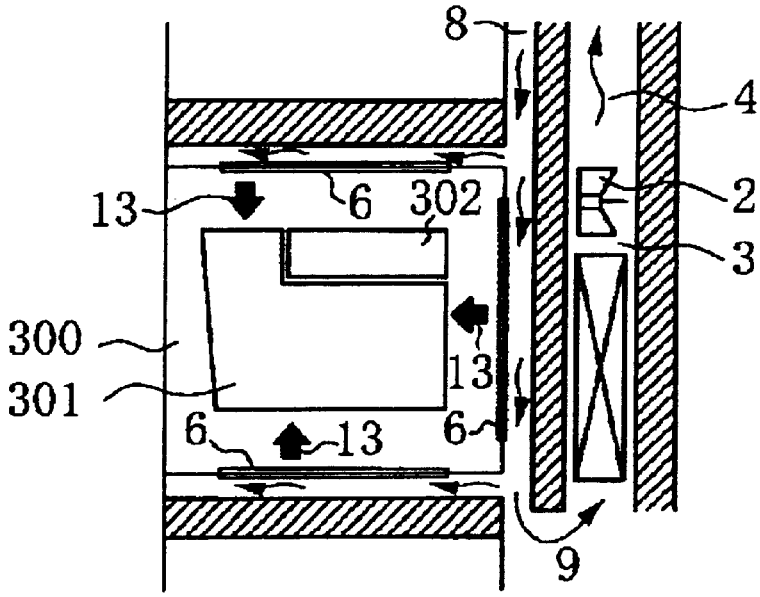
FIG. 8 is a structural drawing of a vegetable compartment of the refrigerator according to the first embodiment of the present invention.

FIG. 8 is a side sectional view of the structure of another vegetable compartment of the refrigerator according to the present invention. A reference numeral denotes a metal sheet 6. The cool air 4 which is cooled in the cooling device chamber 3 is circulated through the refrigerator room by the fan 2 as shown in FIG. 1 and FIG. 3. The vegetable compartment 300 is cooled by receiving return cool air from the refrigerator room 100 circulating through the return passage 8 for the refrigerator room. Then, the return cool air returns to the cooling device chamber 3 through the return passage 9 for the vegetable compartment. It is to be noted in this case that the return cool air is not directly blown into the vegetable compartment. The vegetable compartment is cooled through the radiation cooling 13 with the return cool air supplied to the air ducts 5 for cooling the vegetable compartment which are provided on all or part of the top, back, and bottom surfaces of the vegetable compartment. On all or some of the top, back, and bottom surfaces of the vegetable compartment, the metal sheet 6, such as a stainless steel or aluminum sheet which is highly heat conductive may be installed as part of the components. This may improve the temperature distribution in the vegetable compartment as well as enhance a radiation cooling effect, which allows the vegetable compartment to be provided with a constant temperature. In addition to that, this metal sheet 6 may be fitted on all or some of the top, back, and bottom surfaces of the vegetable compartment by hooking onto a plastic part without welding or screwing. This may also contribute to convenience in decomposing the refrigerator for recycling.

Figure 9:
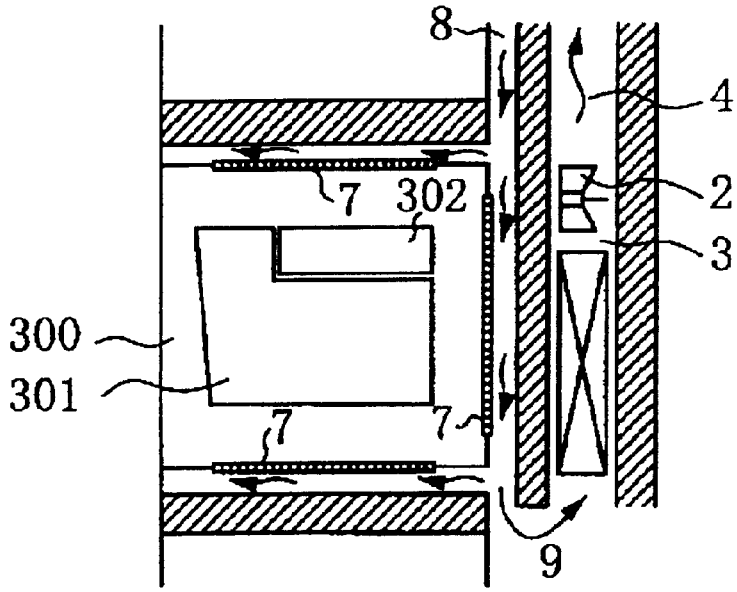
FIG. 9 is a structural drawing of a vegetable compartment of the refrigerator according to the first embodiment of the present invention.

FIG. 9 is a side sectional view of the structure of another vegetable compartment of the refrigerator according to the present invention. A reference numeral 7 denotes a moisture-vapor transmitting sheet. The cool air 4 which is cooled in the cooling device chamber 3 is circulated through the refrigerator room by the fan 2. The vegetable compartment 300 is cooled by receiving return cool air from the refrigerator room 100 circulating through the return passage 8 for the refrigerator room. Then, the return cool air returns to the cooling device chamber 3 through the return passage 9 for the vegetable compartment. It is to be noted in this case that the return cool air is not directly blown into the vegetable compartment. The vegetable compartment is cooled through the radiation cooling 13 with the return cool air supplied to the air ducts 5 for cooling the vegetable compartment which are provided on all or part of the top, back, and bottom surfaces of the vegetable compartment. For that reason, the vegetable compartment is completely closed, and convection is minimized in the vegetable compartment. As a result, dehydration may be minimized in vegetables so that food is allowed to be kept highly moisturized. If applying the porous and highly hydrophilic moisture-vapor transmitting sheet 7 to all or some of the top, back and bottom surfaces of the vegetable compartment, water emitted from the moisture-vapor transmitting sheet 7 may highly humidify the vegetable compartment. As a result, food is allowed to be stored fresh longer. The moisture-vapor transmitting sheet 7 for holding high humidity is a product of high-density polyethylene including zeolite. The moisture-vapor transmitting sheet 7 has a highly hydrophilic porous structure including air space for keeping water molecules. The moisture-vapor transmitting sheet 7 is fitted, in the same manner as the metal sheet 6 mentioned above, on the surfaces. Thus, with the moisture-vapor transmitting sheet, sufficient humidity is held in the compartment in a cycle where water in the vegetable compartment is absorbed by the moisture-vapor transmitting sheet and then emitted back to the compartment.

Figure 10:
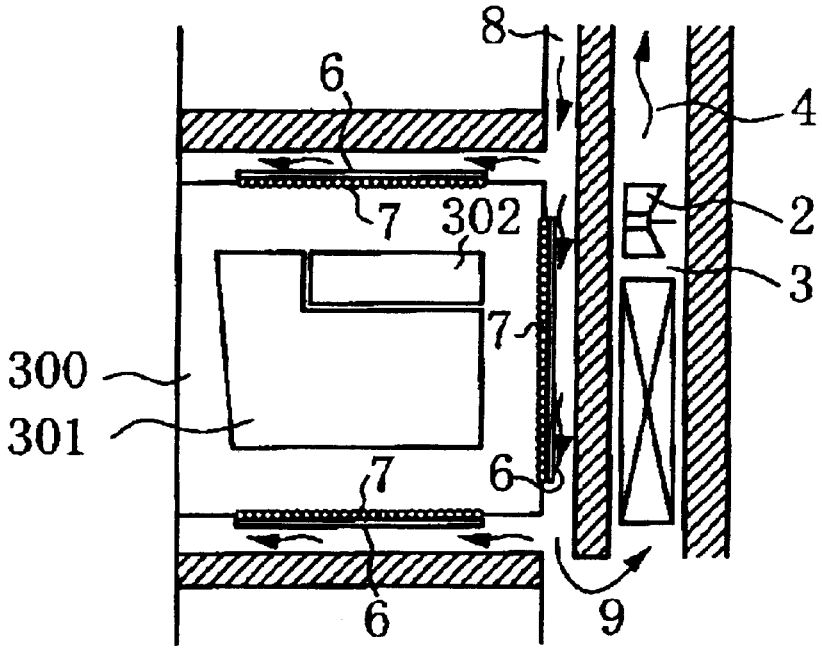
FIG. 10 is a structural drawing of a vegetable compartment of the refrigerator according to the first embodiment of the present invention.

FIG. 10 is a side sectional view of the structure of another vegetable compartment of the refrigerator according to the present invention. The cool air 4 which is cooled in the cooling device chamber 3 is circulated through the refrigerator room by the fan 2. The vegetable compartment 300 is cooled by receiving return cool air from the refrigerator room 100 circulating through the return passage 8 for the refrigerator room. Then, the return cool air returns to the cooling device chamber 3 through the return passage 9 for the vegetable compartment. It is to be noted in this case that the return cool air is not directly blown into the vegetable compartment. The vegetable compartment is cooled through the radiation cooling with the return cool air supplied to the air ducts 5 for cooling the vegetable compartment which are provided on all or part of the top, back, and bottom surfaces of the vegetable compartment. All or part of the top, back and bottom surfaces of the vegetable compartment may be formed by using a combination of the metal sheet 6 on the air duct 5 side and the porous and hydrophilic moisture-vapor transmitting sheet 7 on the vegetable compartment 300 side. This may provide a radiation cooling effect and high humidity by water emission at the same time. In addition to that, the moisture-vapor transmitting sheet absorbs dew formed by difference in the heat capacity of the metal part as a result of high humidity, so that dew forming is prevented in the vegetable compartment. Then, at the same time, the moisture-vapor transmitting sheet emits absorbed water back to the vegetable compartment so that the vegetable compartment is allowed to be further humidified.

Figure 11:
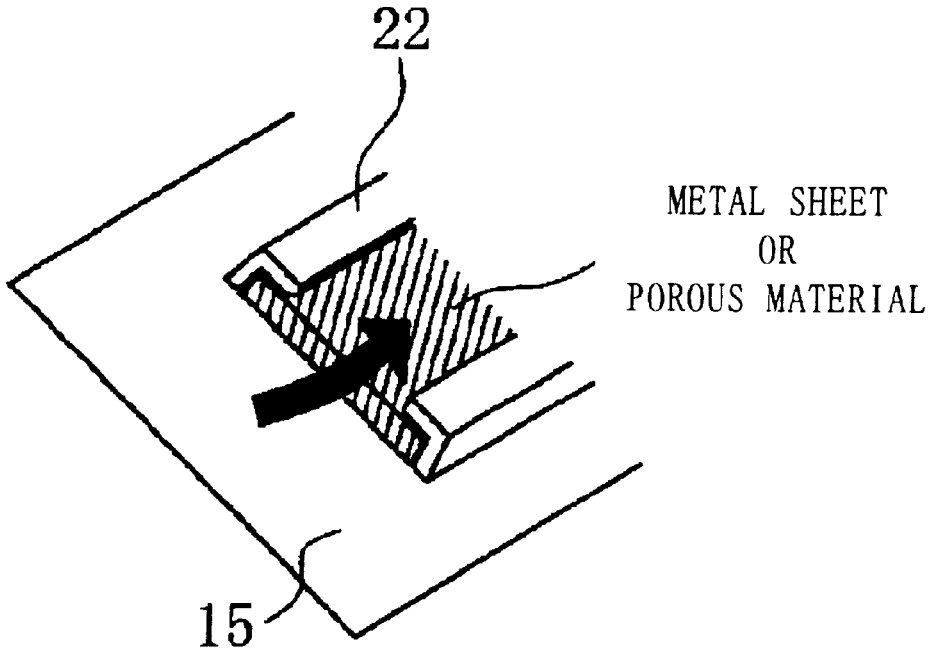
FIG. 11 is a partial structural drawing of a vegetable compartment of the refrigerator according to the first embodiment of the present invention.

Now, a structure for fitting the metal sheet 6 and the moisture-vapor transmitting sheet 7 discussed with reference to FIG. 8, FIG. 9 and FIG. 10 on the partition part 14, 15, 16 is discussed. FIG. 11 is an explanatory diagram of fitting a radiation cooling unit. A reference numeral 22 denotes a guide rib. As shown in FIG. 2, the partition part 15, 16 is fixed between the partition part 14 and the divider 21. The partition part 15, 16 is set, normally before foaming the inner casing, between the divider formed in the inner casing and the fixed partition part 14, and then fixed by the foaming. Prior to this setting, when the partition part 15 is an individual body, the metal sheet is inserted through the guide ribs 22 provided on the partition part 15, as shown in FIG. 11. The partition part 15, 16 is covered by plastic on the top surface and the bottom surface of the styrene heat insulating material 20 and built in the refrigerator. The partition part is fitted between the divider and the back surface material (the partition part 14) to form a partition between compartments. A hole is formed on the vegetable compartment side of the partition part 15, 16 at a place facing the cooling air duct. Such as the metal sheet 6 is fitted through the guide ribs around the hole so as to seal this hole. The partition part 14 is also provided with an opening at a place facing the cooling air duct 5 for the vegetable compartment. Then, such as the metal sheet 6 or the moisture-vapor transmitting sheet 7 is fixed, before foaming the inner casing, by hanging on the hooks of the ribs so that the opening is sealed. This is applicable to the case of using the metal sheet 6 and the moisture-vapor transmitting sheet 7 in combination. As a result, the cold of cool air in the air duct 5 refrigerates the vegetable compartment through the radiation cooling 13 by means of such as the metal sheet 6. Then, the cooling performance may be more improved than the radiation cooling from a plastic sheet. In the case of using the porous moisture-vapor transmitting sheet 7 alone, it does not matter whether an opening is provided between the air duct 5 and the-sheet or not. The moisture-vapor transmitting sheet serves for absorbing and holding water in the vegetable compartment. That means that the moisture-vapor transmitting sheet holds water obtained from food when the temperature of the vegetable compartment becomes lower through the radiation cooling, and emits the water when the flow of cool air is stopped in the air duct 5.

Embodiment 2

Figure 12:
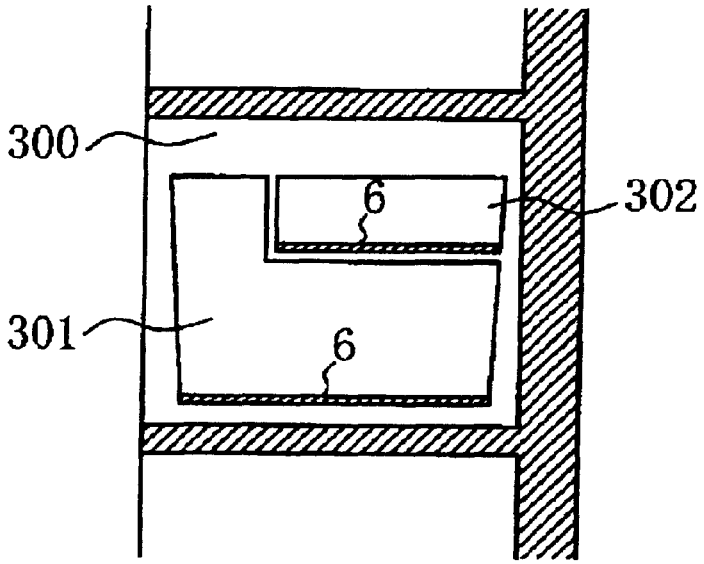
FIG. 12 is a structural drawing of a vegetable compartment of a refrigerator according to a second embodiment of the present invention.

FIG. 12 shows another embodiment of a refrigerator according to the present invention and is a side sectional view of the structural drawing of the vegetable compartment discussed with reference to FIG. 1 to FIG. 4. Reference numeral 301 represents the vegetable case contained in the vegetable compartment 300 and reference numeral 302 represents the fruit case which is allowed to slide on the vegetable case. As shown in the drawing, the metal sheet 6 may be provided as part of the vegetable case 301 and the fruit case 302, whereby the radiation cooling effect for cooling the vegetable compartment may be enhanced through radiation from the metal sheet. At the same time, this structure may also contribute to improving temperature distribution within the vegetable case and the fruit case thereby allowing the cases in the vegetable compartment to have a constant temperature. The metal sheets if provided on the bottom surfaces of the cases may be formed integrally with the plastic parts of the cases, or alternatively, the metal sheets may be fitted on the cases by parts such as a screw. In this case, the metal sheets are exposed in the compartment, and therefore the cases are allowed to receive cold effectively by cool air inside the compartment through the radiation cooling 13.

Figure 13:
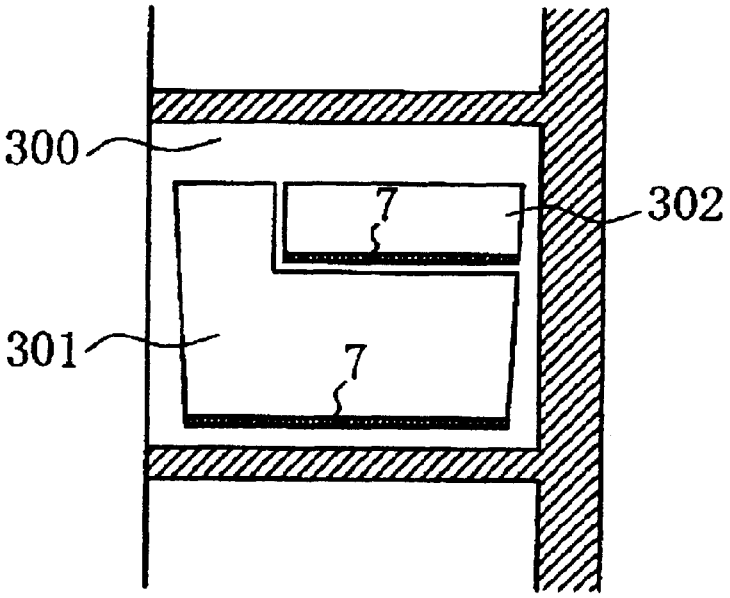
FIG. 13 is a structural drawing of a vegetable compartment of the refrigerator according to the second embodiment of the present invention.

FIG. 13 shows an example of a refrigerator according to the present invention and is a side sectional view of the structural drawing of a similar vegetable compartment to that of FIG. 12. As shown in the figure, the porous and highly hydrophilic moisture-vapor transmitting sheet 7 may be provided as parts of the vegetable case 301 and the fruit case 302. As a result, the moisture-vapor transmitting sheet 7 emits water, so that the vegetable case and the fruit case are allowed to be highly humidified inside constantly. In the case of applying the porous material to the bottom surface, it is desirable to fit it on the plastic bottom surface. The metal sheet 6 or the moisture-vapor transmitting sheet 7 may be provided on the sides of the cases other than the bottom surfaces. With such location, load(s) on the metal sheet and the porous material may be small, and therefore the metal sheet or the porous material may be fitted into such as slot-type guide ribs or hooks on the sides of the cases.

Figure 14:
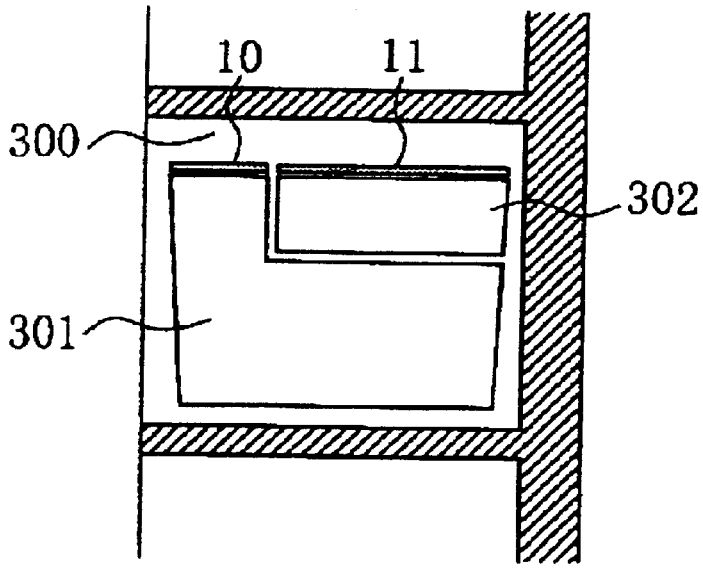
FIG. 14 is a structural drawing of a vegetable compartment of the refrigerator according to the second embodiment of the present invention.

FIG. 14 shows an example of the refrigerator according to the present invention and is a side sectional view of the structural drawing of a similar vegetable compartment. Reference numerals 10 and 11 denote sliding lid structures for sealing the cases. As shown in the figure, the vegetable case and the fruit case may be provided with the lid structures 10 and 11, respectively. As a result, the vegetable case and the fruit case are sealed, so that food such as vegetables is allowed to be kept moisturized in separated smaller spaces other than the entire vegetable compartment. This allows the cases to be highly humidified inside. At the same time, temperature fluctuations and humidity fluctuations in the vegetable case and the fruit case caused by opening the door of the vegetable compartment may be minimized. Hence, a vegetable compartment having a stable condition for storing food may be provided.

Figure 15:
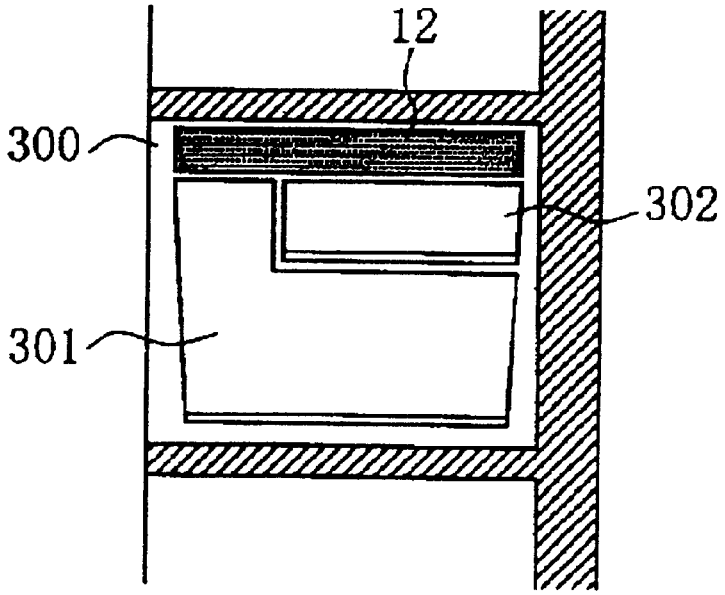
FIG. 15 is a structural drawing of a vegetable compartment of the refrigerator according to the second embodiment of the present invention.
Figure 16:
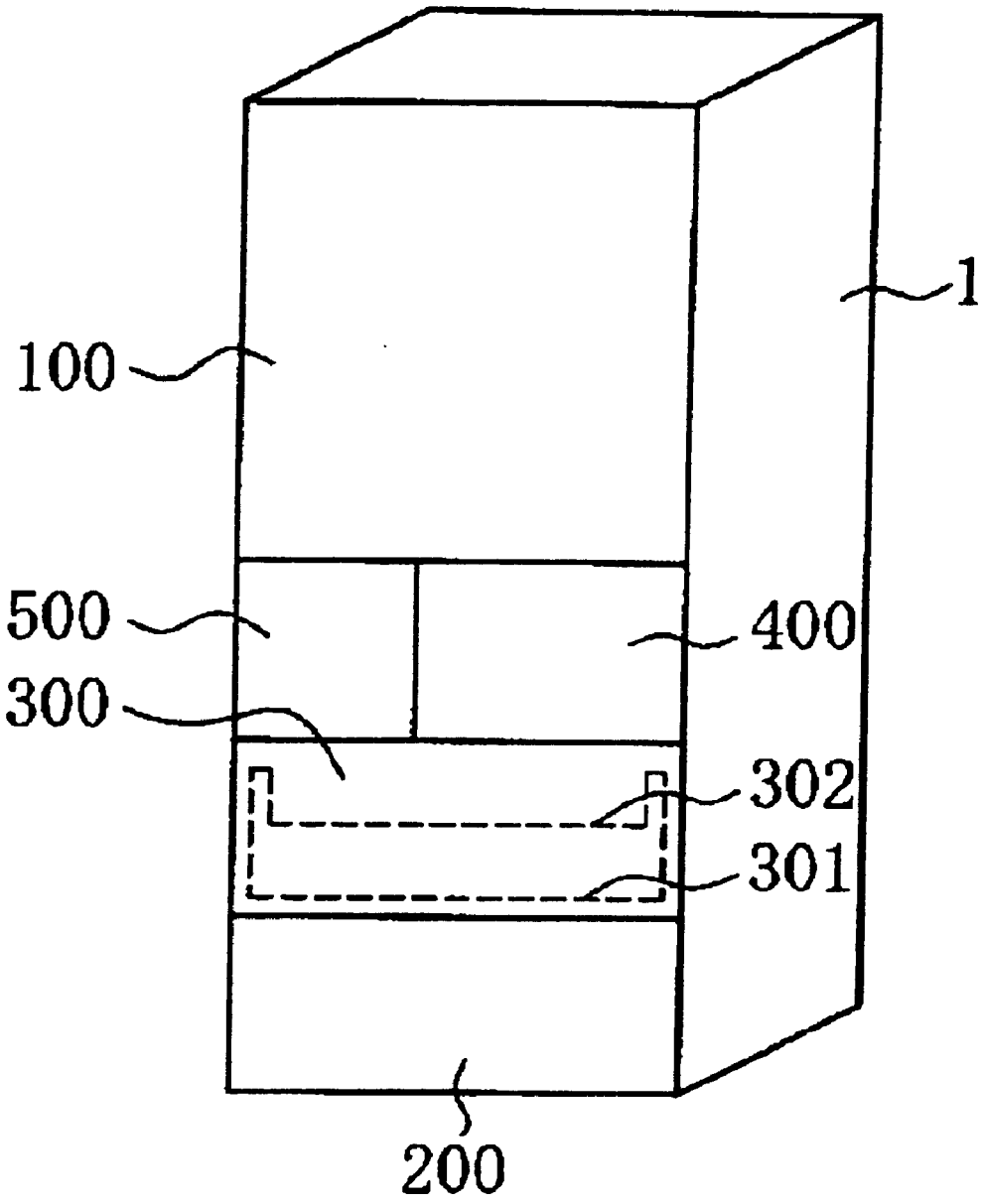
Fig. 16 CONVENTIONAL ART
FIG. 16 is a layout drawing of a vegetable compartment according to a conventional refrigerator.
Figure 17:
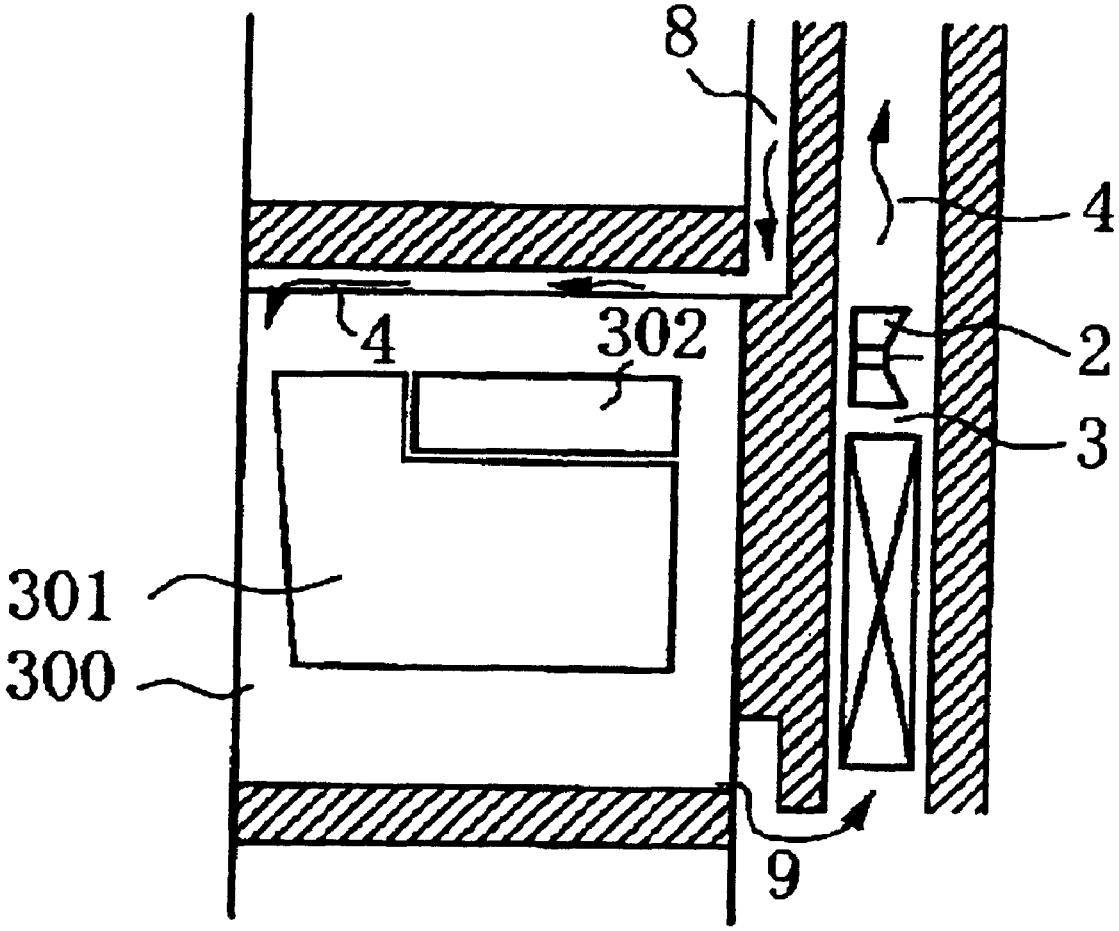
Fig. 17 CONVENTIONAL ART
FIG. 17 is a structural drawing of the vegetable compartment according to the conventional refrigerator.

FIG. 15 shows an example of the refrigerator according to the present invention and is a side sectional view of the structural drawing of a similar vegetable compartment. A reference numeral 12 denotes a packing structure for sealing the cases 301 and 302. The packing structure 12 is provided with a packing which is fixed on the top surface of the vegetable compartment. The packing is disengaged from the cases when the case is drawn out, and comes in contact with the cases at the top on the four circumferential sides so as to seal the cases automatically when the cases are pushed back in the compartment and then the door is closed. In this case, the packing structure may be formed integrally with the lids, or alternatively, the lids may be fitted with the cases. Thus, the vegetable case and the fruit case may be provided with the lid structure in such a manner that the cases are allowed to be sealed by packing. In thus sealing, the packing may come into the cases and contact with the inner walls of the cases, or alternatively, the opposite way will do. Thus, the packing structure 12 may be provided on the inner or outer circumference of the lids, whereby the vegetable case and the fruit case are sealed. As a result, food such as vegetables is allowed to be kept moisturized in separated smaller spaces other than the entire vegetable compartment. This allows the cases to be highly humidified inside. At the same time, this may provide easy access to vegetables stored in the vegetable case and the fruit case without a lid structure when opening/closing the door of the vegetable compartment. This may achieve easy access to food as well as high humidity in the cases at the same time. Dual sealing may alternatively be provided in the vegetable compartment 300 by sealing the cases with the lids 10 and 11 and the packing structure 12, and by the structure of isolating the vegetable compartment 300 from cool air. As a result, the compartment is isolated from the flow of cool air because of the radiation cooling. At the same time, food may be kept without the circulation of cool air caused by convection in the compartment by heat from the cases. Furthermore, convection from the sides and the bottom surface of the case may be minimized. Specifically, with the packing structure, convection from the top surface of the case may be stopped rather than from the lids.

The fridge-freezer is provided with a convertible compartment which is provided above the vegetable compartment and allowed to switch temperatures in a range from a freezing temperature (−18° C.) to cooling temperatures, temperatures for keeping vegetables, and chilling temperatures, an ice-maker which is placed next to the convertible compartment and above the vegetable compartment, a freezer which is placed below the vegetable compartment, and a cooling device chamber at the back of the vegetable compartment. The vegetable compartment is cooled by using return cool air from the refrigerator room. The vegetable compartment is provided with the function of minimizing temperature fluctuations in the vegetable compartment through the radiation cooling for cooling without supplying the cool air directly to the vegetable compartment. As a result, vegetables are allowed to be kept fresh longer in high quality.

The fridge-freezer is provided with a convertible compartment which is provided above the vegetable compartment and allowed to switch temperatures in a range from a freezing temperature (−18° C.) to cooling temperatures, temperatures for keeping vegetables, and chilling temperatures, an ice-maker which is placed next to the convertible compartment and above the vegetable compartment, a freezer which is placed below the vegetable compartment, and a cooling device chamber at the back of the vegetable compartment. The vegetable compartment is cooled by using return cool air from the refrigerator room without supplying the cool air directly to the vegetable compartment. The vegetable compartment is provided with the humidifying function of the vegetable compartment by completely sealing the vegetable compartment. As a result, a fridge-freezer provided with the vegetable compartment capable of keeping food fresh longer may be obtained.

On all or some of the top, back, and bottom surfaces of the vegetable compartment, the metal material may be used thereby cooling the vegetable compartment through radiation from the metal sheet. Hence, a highly efficient fridge-freezer may be obtained.

On all or some of the top, back and bottom surfaces of the vegetable compartment, the porous and highly hydrophilic moisture-vapor transmitting sheet which is made from a high-density polyethylene substance including zeolite as the primary material may be used, so that the vegetable compartment is highly humidified by water emitted from the moisture-vapor transmitting sheet. Hence, a fridge-freezer which allows vegetables to be kept fresh longer may be obtained.

On all or part of the top, back and bottom surfaces of the vegetable compartment, a combination of the metal material and the porous and hydrophilic moisture-vapor transmitting sheet may be used. As a result, the moisture-vapor transmitting sheet absorbs dew formed by difference in the heat capacity of the metal part, and then the vegetable compartment is highly humidified by water emission, and at the same time dew forming is prevented in the vegetable compartment. Hence, a highly efficient and convenient refrigerator may be obtained.

The metal material may be used as part of the vegetable case and the fruit case, so that the cases may be cooled inside through radiation from the metal sheet. Hence, a highly efficient fridge-freezer may be obtained.

The porous and highly hydrophilic moisture-vapor transmitting sheet may be used as parts of the vegetable case and the fruit case, so that the cases are highly humidified inside by water emitted from the moisture-vapor transmitting sheet. Hence, the cases are allowed to be kept highly humidified for a long period.

The lid structure may be provided for the vegetable case and the fruit case, so that the vegetable case and the fruit case are sealed, and thus allowed to be highly humidified.

The packing structure may be provided on the outer and inner circumferences of the vegetable case and the fruit case, so that the vegetable case and the fruit case are sealed, and allowed to be highly humidified. Thus, the temperature fluctuations in the vegetable compartment may be minimized through the radiation cooling without supplying cool air directly into the vegetable compartment, and at the same time, the vegetable compartment is allowed to be completely sealed. As a result, the vegetable compartment is allowed to be kept high humidified. Further, the metal sheet may be used on all or some of the top, back, and bottom surfaces of the vegetable compartment, or part of the vegetable case and the fruit case to enhance the radiation cooling effect. In addition to that, the porous and highly hydrophilic moisture-vapor transmitting sheet may be used on all or some of the top, back and bottom surfaces of the vegetable compartment, or part of the vegetable case and the fruit case to allow the vegetable compartment to be highly humidified by water emitted from the moisture-vapor transmitting sheet.

Thus, the vegetable compartment is subject to the radiation cooling without supplying cool air directly into the vegetable compartment, and therefore the temperature fluctuations in the vegetable compartment are minimized. Hence, a refrigerator having a steady temperature in the vegetable compartment may be provided. Further, by sealing the vegetable compartment, dehydration in food may be minimized. Hence, a refrigerator which allows food stored in the vegetable compartment to be kept highly humidified may be provided. By forming the walls of the vegetable compartment with the metal parts, such a refrigerator may be provided that the radiation cooling effect is allowed to be enhanced in the vegetable compartment and at the same time the temperature distribution in the vegetable compartment may be desirable. By forming the walls of the vegetable compartment with the porous and highly hydrophilic moisture-vapor transmitting sheet, such a refrigerator may be provided that the vegetable compartment is allowed to be highly humidified by water emitted from the moisture-vapor transmitting sheet. By forming the walls of the vegetable compartment with the combination of the metal part and the porous and highly hydrophilic moisture-vapor transmitting sheet, such a refrigerator may be provided that radiation cooling and high humidity are achieved at the same time and also dew forming is prevented in the vegetable compartment. By using the metal material as part of the vegetable case and the fruit case, such a refrigerator may be provided that the radiation cooling effect is enhanced, temperature distribution is improved in the vegetable compartment, and a steady temperature is secured for keeping vegetables. By using the porous and highly hydrophilic moisture-vapor transmitting sheet as part of the vegetable case and the fruit case, such a refrigerator may be provided that high humidity is achieved in the vegetable case and the fruit case by water emitted from the moisture-vapor transmitting sheet, and food is allowed to be kept fresh longer. By providing the lid structure for the vegetable case and the fruit case, such a refrigerator may be provided that the case is sealed and highly humidified inside, the temperature fluctuations and the humidity fluctuations in the cases caused by opening the vegetable compartment are minimized, and a stable condition is ensured for keeping food. By providing the packing structure on the outer and inner circumferences of the vegetable case and the fruit case instead of the lid structure, such a refrigerator may be provided that the cases are sealed and highly humidified inside, easy access to vegetables may be achieved, and convenience in use and high humidity in the compartment are achieved at the same time.

The effects of the fridge-freezer according to the present invention may be summarized as follows.

The fridge-freezer according to the present invention is characterized by having the food storage which is placed vertically between compartments such as the refrigerator room and the freezer via partition parts, and formed so that food such as vegetables stored therein is allowed to be taken out by opening/closing the door, the cooling device chamber, the cooling air ducts for guiding return cool air from such as the refrigerator room to the cooling device chamber through the partition parts for separating the food storage from the compartments, the radiation cooling unit, which is provided between at least a part of the cooling air ducts and the food storage, for performing radiation cooling of the food storage by cold of cool air in the cooling air ducts, and the storage case which is contained in the food storage and allowed to be sealed for storing food such as vegetables. Thus, the food storage is cooled without receiving cool air directly. As a result, dehydration in fresh food may be prevented.

The fridge-freezer according to the present invention is characterized by having the food storage for storing food such as vegetables, the refrigerator room which is placed above the food storage, the freezer which is placed below the food storage, the cooling device chamber which is placed at the back of the food storage, the partition parts for separating the food storage at least from the freezer and the cooling device chamber, the radiation cooling units, which are provided on the partition parts, for cooling the food storage by the return cool air from the refrigerator room without supplying the return cool air directly to the food storage, and the storage case which is contained in the food storage and allowed to be sealed for storing food such as vegetables. Then, the food storage is cooled by isolating food from the flow of cool air. As a result, the fridge-freezer may keep food fresh longer.

The fridge-freezer according to the present invention is characterized by having the compartments which are provided above and below the food storage, and whose temperatures are allowed to be set to freezing temperatures (−18° C.). Then, the cooling device chamber is provided in the back part of the food storage, and the food storage is arranged so as to be surrounded, via the partition parts, by the compartments and the cooling device chamber whose temperatures are set to freezing temperatures. As a result, the convenient and efficient fridge-freezer may be provided.

The fridge-freezer according to the present invention is characterized that the metal material is used to form at least one of the top surface, back surface, and bottom surface of the food storage so as to cool the food such as vegetables through the radiation cooling from the metal material. As a result, the fridge-freezer is highly efficient.

The fridge-freezer according to the present invention is characterized that the moisture-vapor transmitting sheet, which is porous and highly hydrophilic, is used to form at least one of the top surface, back surface, and bottom surface of the food storage so as to humidify the food storage through the water emission from the moisture-vapor transmitting sheet. As a result, the fridge-freezer may keep food fresh without difficulties.

The fridge-freezer according to the present invention is characterized that the combination of the metal material and the moisture-vapor transmitting sheet, which is porous and highly hydrophilic, is used to form at least one of the top surface, back surface, and bottom surface of the food storage so that the moisture-vapor transmitting sheet absorbs dew formed by difference in heat capacity of the metal material and highly humidifies the food storage through the water emission, and also prevents the dew forming in the food storage. As a result, the highly reliable and convenient refrigerator is provided.

The fridge-freezer according to the present invention is characterized that the storage case is formed by partly using the metal material so as to be cooled inside through the radiation cooling from the metal material. As a result, the fridge-freezer may improve its performance with the simple structure.

The fridge-freezer according to the present invention is characterized that the storage case is formed by partly using the moisture-vapor transmitting sheet, which is porous and highly hydrophilic, so as to be highly humidified inside through the water emission from the moisture-vapor transmitting sheet. As a result, the fridge-freezer is simply structured and convenient in use.

The fridge-freezer according to the present invention is characterized that the storage case is provided with the lid, which is sealed by the packing structure, so as to be highly humidified inside. As a result, the fridge-freezer may further improve its performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fridge-freezer comprising:

a food storage which is placed vertically between compartments including a refrigerator room and a freezer via partition parts, and formed so that food stored therein is allowed to be taken out by opening/closing a door;

a cooling device chamber;

cooling air ducts for guiding return cool air from the refrigerator room to the cooling device chamber through the partition parts for separating the food storage from the compartments;

a radiation cooling unit, which is provided between at least a part of the cooling air ducts and the food storage, for performing radiation cooling of the food storage by cold of cool air in the cooling air ducts; and a storage case which is contained in the food storage and allowed to be sealed for storing food;

wherein the food storage is cooled without receiving cool air directly.

2. A fridge-freezer comprising:

a food storage for storing food;

a refrigerator room which is placed above the food storage;

a freezer which is placed below the food storage;

a cooling device chamber which is placed at a back of the food storage;

partition parts for separating the food storage at least from the freezer and the cooling device chamber;

radiation cooling units which are provided on the partition parts, for cooling the food storage by return cool air from the refrigerator room without supplying return cool air directly to the food storage; and a storage case which is contained in the food storage and allowed to be sealed for storing food;

wherein the food storage is cooled by isolating the food from a flow of cool air.

3. The fridge-freezer of claim 1 or 2, further comprising:

compartments which are provided above and below the food storage, and whose temperatures are allowed to be set to freezing temperatures, wherein the cooling device chamber is provided in a back part of the food storage, and the food storage is arranged so as to be surrounded, via the partition parts, by the compartments and the cooling device chamber whose temperatures are set to freezing temperatures.

4. The fridge-freezer of claim 1 or 2, wherein a metal material is used to form at least one of a top surface, a back surface, and a bottom surface of the food storage so as to cool the food through the radiation cooling from the metal material.

5. The fridge-freezer of claim 1 or 2, wherein a moisture-vapor transmitting sheet, which is porous and highly hydrophilic, is used to form at least one of a top surface, a back surface, and a bottom surface of the food storage so as to humidify the food storage through water emission from the moisture-vapor transmitting sheet.

6. The fridge-freezer of claim 1 or 2, wherein a combination of a metal material and a moisture-vapor transmitting sheet, which is porous and highly hydrophilic, is used to form at least one of a top surface, a back surface, and a bottom surface of the food storage so that the moisture-vapor transmitting sheet absorbs dew formed by difference in heat capacity of the metal material and highly humidifies the food storage through water emission, and also prevents dew forming in the food storage.

7. The fridge-freezer of claim 1 or 2, wherein the storage case is formed by partly using a metal material so as to be cooled inside through radiation cooling from the metal material.

8. The fridge-freezer of claim 7, wherein the storage case is provided with a lid, which is sealed by a packing structure, so as to be highly humidified inside.

9. The fridge-freezer of claim 1 or 2, wherein the storage case is formed by partly using a moisture-vapor transmitting sheet, which is porous and highly hydrophilic, so as to be highly humidified inside through water emission from the moisture-vapor transmitting sheet.

10. The fridge-freezer of claim 9, wherein the storage case is provided with a lid, which is sealed by a packing structure, so as to be highly humidified inside.

11. A fridge-freezer comprising:

a food storage placed between first and second compartments and separated from the compartments via partition parts, the food storage configured so that food can be placed therein and removed by opening and closing a door;

a cooling device chamber;

cooling air ducts configured to guide return cool air from the first compartment to the cooling device chamber through the partition parts;

a radiation cooling unit provided between at least a portion of the cooling air ducts and the food storage configured to perform radiation cooling of the food storage by cool air in the cooling air ducts; and a storage case contained in the food storage configured to be sealed for storing food;

wherein an interior of the food storage is cooled without receiving cool air directly.

12. The fridge-freezer of claim 11, further comprising:

third and fourth compartments provided above and below the food storage, respectively, configured such that temperatures thereof can be set to freezing temperatures, wherein the food storage is arranged so as to be surrounded, via the partition parts, by the third and fourth compartments and the cooling device chamber.

13. The fridge-freezer of claim 11, wherein a metal material forms at least one of a top surface, a back surface, and a bottom surface of the food storage and is configured to cool the interior of the food storage through radiation cooling from the metal material.

14. The fridge-freezer of claim 11, wherein a moisture-vapor transmitting sheet that is porous and hydrophilic forms at least one of a top surface, a back surface, and a bottom surface of the food storage and is configured to humidify the food storage through water emission from the moisture-vapor transmitting sheet.

15. The fridge-freezer of claim 11, wherein a metal material and a moisture-vapor transmitting sheet that is porous and hydrophilic form at least one of a top surface, a back surface, and a bottom surface of the food storage, the moisture-vapor transmitting sheet configured to absorb condensate formed by a heat capacity of the metal material, configured to humidify the food storage through water emission, and configured to prevent condensate from forming in the food storage.

16. The fridge-freezer of claim 11, wherein at least part of the storage case is formed by a metal material configured to cool an interior of the storage case through radiation cooling from the metal material.

17. The fridge-freezer of claim 16, wherein the storage case includes a lid that is sealed by a packing structure, the lid and packing structure configured to prevent an escape of moisture from the interior of the storage case.

18. The fridge-freezer of claim 11, wherein at least part of the storage case is formed by a moisture-vapor transmitting sheet that is porous and highly hydrophilic configured to humidify an interior of the storage case through water emission from the moisture-vapor transmitting sheet.

19. The fridge-freezer of claim 18, wherein the storage case includes a lid that is sealed by a packing structure, the lid and packing structure configured to prevent an escape of moisture from the interior of the storage case.

* * * * *